US005543190A

United States Patent [19]

Johnson et al.

[11] Patent Number: 5,543,190

[45] Date of Patent: Aug. 6, 1996

[54] ALBUM CONTAINING PADS OF TWO-SIDE COATED REPOSITIONABLE TAPES

[75] Inventors: Dee L. Johnson, Woodbury; Kenneth F. Knoll, Hastings; John R. David, Stillwater, all of Minn.

[73] Assignee: Minnesota Mining and Manufacturing Company, St. Paul, Minn.

[21] Appl. No.: 260,691

[22] Filed: Jun. 16, 1994

[51] Int. Cl.[6] ..... B42F 5/00; G09F 1/10

[52] U.S. Cl. ..... 428/40.1; 40/124.1; 40/594; 40/700; 40/725; 40/726; 40/773; 281/22; 281/38; 281/44; 283/37; 462/72; 462/901; 428/201; 428/202; 428/354; 428/355

[58] Field of Search ..... 428/40, 41, 42, 428/200, 201, 202, 354, 343, 355; 40/152, 158.1, 156, 124.1, 594, 726, 700, 725, 768, 773; 462/72, 901; 281/44, 81, 101, 38, 22; 283/37

[56] References Cited

U.S. PATENT DOCUMENTS

| | | | |
|---|---|---|---|
| 2,030,135 | 2/1936 | Carpenter | 428/202 |
| 2,156,815 | 5/1939 | Levy | 40/124.1 |
| 2,387,593 | 10/1945 | Lesser | 428/190 |
| 2,565,509 | 8/1951 | Marcin | 206/447 |
| 2,889,038 | 6/1959 | Kalleberg | 428/354 |
| 3,203,823 | 8/1965 | Grimes | 428/354 |
| 3,857,731 | 12/1974 | Merrill | 428/314.4 |
| 4,110,923 | 9/1978 | Shore | 40/158.1 |
| 4,140,565 | 2/1979 | Parker | 40/158.2 |
| 4,582,737 | 4/1986 | Torgerson et al. | 428/57 |
| 4,599,265 | 7/1986 | Esmay | 428/355 |
| 4,770,914 | 9/1988 | Torgerson et al. | 428/57 |
| 4,842,919 | 6/1989 | David et al. | 428/40 |
| 4,883,553 | 11/1989 | David et al. | 156/193 |
| 4,917,753 | 4/1990 | Torgerson et al. | 156/324 |
| 4,921,747 | 5/1990 | Studley | 428/195 |
| 4,978,143 | 12/1990 | Ericson | 283/37 |
| 5,202,169 | 4/1993 | Spendlove | 428/354 |
| 5,411,168 | 5/1995 | Mertens | 221/22 |

FOREIGN PATENT DOCUMENTS

| | | |
|---|---|---|
| 0118250A3 | 9/1984 | European Pat. Off. . |
| 2165096 | 8/1973 | France . |

*Primary Examiner*—Nasser Ahmad

*Attorney, Agent, or Firm*—Gary L. Griswold; Walter N. Kirn; Mark A. Litman

[57] ABSTRACT

An album comprising more than two pages, said album having a stack of sheets attached thereto, at least some of said sheets being removable from said stack and having repositionable adhesive on both sides of said sheets which are removable.

25 Claims, 1 Drawing Sheet

ALBUM CONTAINING PADS OF TWO-SIDE COATED REPOSITIONABLE TAPES

BACKGROUND OF THE INVENTION

1. Field of the Invention

The present invention relates to albums in which photographs or art work are stored for ready viewing. In particular the albums contain adhesive means which can be used to temporarily hold the photograph or art work in the album.

2. Background of the Art

Photographs and art work, particularly childrens' art work, have been stored by people in albums. The photographs have been stored in albums by securing the photographs to the individual pages of the album. The securement has been accomplished on plain paper page albums by applying liquid adhesive to the back of photographs, applying adhesive tape which extends over a portion of the picture and onto the album page, and double-sided pressure sensitive adhesive tape behind the picture in a strip. Some albums have been made which contain their own means for securing the photographs. This has been done by preapplying pressure sensitive adhesive to the pages of the album (usually with a plastic strippable protective layer over the adhesive which is removed, the picture inserted, and the plastic strip overlaid on the secured picture). Tabs have also been provided which can be adhesively secured onto the pages to hold the corners of the photograph. Each of these methods have achieved some level of success, but each has problems associated with the particular method or materials used.

Some of the methods (e.g., the adhesively secured tabs and direct application of liquid adhesive) permanently adhere the photograph to the paper so that it can not be removed without damaging the photograph and/or the paper in the album. The use of pressure sensitive adhesive can suffer from a similar problem. The properties of the pressure sensitive adhesive can change with time because of solvent loss, chemical reaction, oxidation, or other changes in the adhesive. The changes in properties usually result in an increase in adhesion, and often a change to more permanent adhesion. Additionally, even when conventional pressure sensitive adhesives are used, the initial adhesion can be sufficiently strong so that the removal of the photograph can damage the paper or the photograph.

The use of an album with an overlying plastic sheet on each page reduces the apparent quality of the images by placing a glossy plastic film over the art work. Reflections off the surface of the film causes glare and other effects which reduce the viewable quality of the art work.

Repositionable stick or liquid adhesive is commercially available, such as POST-IT™ Repositionable Adhesive products (3M). The application of such repositionable adhesives can offer the benefit of removability and reduced potential for damage to the paper or the photograph. However, when it is applied to the paper, the adhesive remains on the paper and prevents rearranging of the configuration of the photographs and/or art work, unless one chooses to leave adhesive exposed in various areas. Additionally, the application of adhesive manually allows the user who is less than precise in his/her application of amounts and locations of adhesive the opportunity to leave exposed areas of adhesive even in the first application of pictures in an album.

Two-side coated adhesive tapes are well known in the art. For example, U.S. Pat. Nos. 2,387,593; 2,565,509; 4,582,737; 4,917,783; and 4,770,914 describe various constructions, configurations and compositions of two-side coated adhesive tape. Repositionable adhesives are also known in the art, and the prefered adhesives according to the present invention are those within the scope disclosed in U.S. Pat. No. 3,857,731.

BRIEF DESCRIPTION OF THE INVENTION

The present invention describes an album having multiple pages therein for the temporary storage of art work or photographs on those pages. The pages themselves are not pretreated with a pressure-sensitive adhesive and may be conventional paper stock (uncoated surfaces, matte surfaces, or glossy coated paper stock). Attached to the album, either on an exterior surface or within the covers of the album is at least one pad of sheets, at least some sheets within the pad having repositionable adhesive on both sides of the sheet. Individual sheets having repositionable adhesive on both surfaces may be secured to the back side of art works (including photographs) by one surface of adhesive, and the sheet and art work may then be secured to the page of the album in a desired position. The position of the art work may be repeatedly adjusted and changed, and the sheet may be reused with different art work at a later date, since the sheet may be readily stripped from the paper and/or the photograph.

DETAILED DESCRIPTION OF THE DRAWINGS

Figure 1:
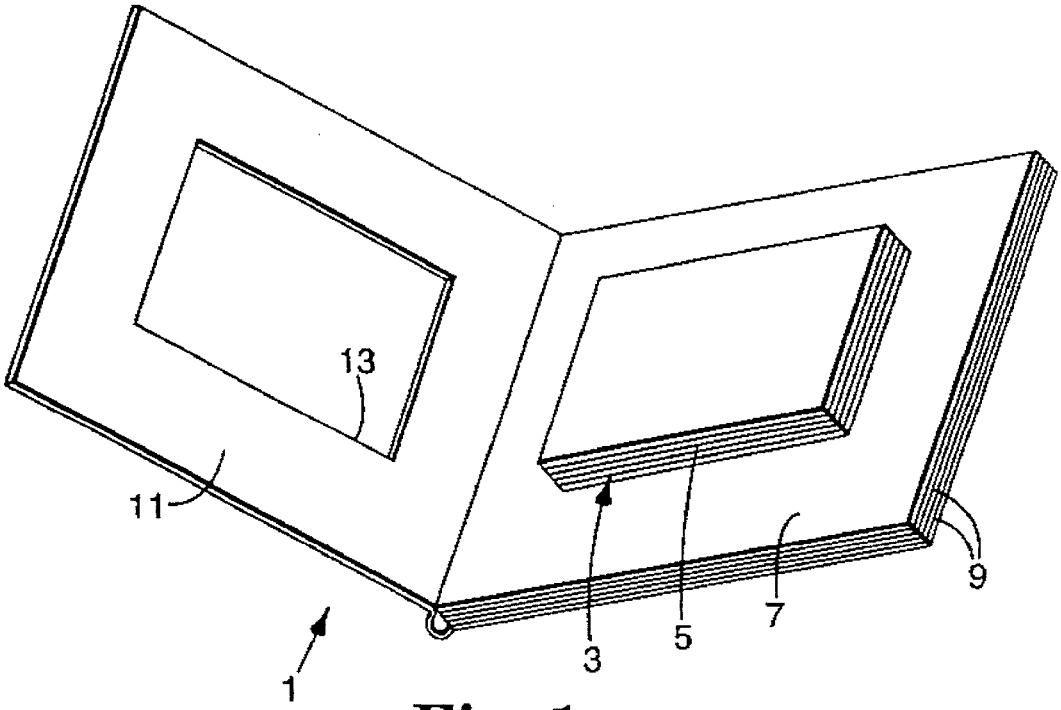
FIG. 1 shows a picture album 1 having a pad 3 of sheets 5 bearing repositionable adhesive on both sides of the sheets (not shown).

FIG. 1 shows an album 1 having a pad 3 of sheets 5 bearing repositionable adhesive on both sides of the sheets (not shown). The pad 5 has a number of adhered sheets 5, usually at least equal in number to the number of pages 9 in the album 3. The pad 3 is adhered to one surface 7 of a page 9, most conveniently a page adjacent an outer cover 11 of the album 3 or on the outer cover 11 itself. An optional opening 13 is shown through which the pad 3 may extend when the album 3 is closed.

Figure 2A:
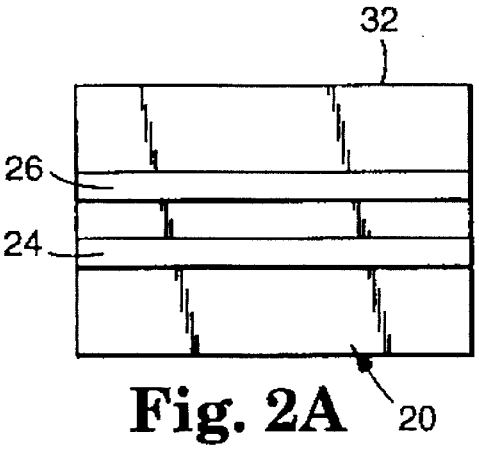
FIG. 2 shows two sides 20 and 22 of a sheet (not independently shown) having stripes 24, 26, 28, and 30 of repositionable adhesive.
Figure 2B:
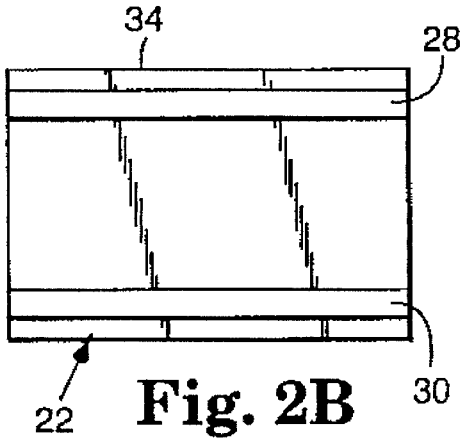

FIGS. 2A and 2B show two sides 20 and 22 of a single sheet (not independently shown) according to the present invention. Stripes of repositionable adhesive 26 and 24 on one side 20 are positioned along the side 20 so that when that side 20 comes into contact with another side 22 and the edges 32 and 34 of the two different sides 20 and 22 are aligned not shown), the stripes 24, 26, 28 and 30 do not contact each other or minimally contact each other.

DETAILED DESCRIPTION OF THE INVENTION

The present invention describes an album having multiple pages therein, and attached to the album a stack of sheets having repositionable adhesive on both sides of the individual sheets.

There are generally at least two pages within the album, more preferably at least eight pages within the album, and more preferably at least twelve pages (one side of a piece of paper comprising a page). The sheets onto which the adhesive is applied may be substantially any sheet material to which the adhesive will adhere. Preferably the sheet is made of paper (again this may be any paper stock such as uncoated paper, matte paper, or glossy coated paper), polymeric film such as polyester (e.g., polyethylene terephthalate, polyethylene naphthalate), polyvinyl resin (e.g., polyvinyl chloride, polyvinyl acetals, polyvinylidene chloride, and copolymers thereof), polyolefin resins (e.g., polyethylene, polypropylene), acetate resins (e.g., cellulose acetate, cellulose tricetate), and the like. Baryta coated paper, polyolefin coated paper, and other commercially available sheet stock may also be used.

Similarly, the material of the individual pages forming the pages of the album may be any suitable composition. Even highly decorative materials such as metallized paper or polymeric film, metal and dye coated paper or film, or preprinted stock with background colors or images may be used for the pages of the album.

The individual adhesive sheets may be part of a continuous stream of sheets which are delineatd by tearable areas. For example, a continuous, folded set of sheets with perforations between the individual attached sheets may be provided. The repositionable adhesive would be located on both sides of the individual sheets in the pad. The sheets may be constructed in any fashion which provides a carrier layer with repositionable adhesive on both sides of the carrier. For example, a conventional double-sided pressure sensitive adhesive tape with aggressive adhesive may secure two sheets together, each of those sheets having repositionable adhesive on the surfaces away from the two-side coated adhesive tape. Any other format of providing two surfaces of repositionable adhesive which are secured together is functional in the practice of the present invention as a sheet.

The repositionable adhesive may be any commercially available repositionable adhesive. The adhesive is applied to both sides of the individual sheets of a pad, although the coatings on each side do not have to cover the entire area of the surface of the sheet on either side of the sheet. In one embodiment of the invention, both sides of the sheet may be uniformly and completely covered by repositionable adhesive, but this is less preferred than other coating orientations both mechanically and economically. A preferred construction of the individual sheets of the pad is to have discontinuous coatings on at least one side or both sides of the individual sheets. The discontinuous coatings may be in the form of rows, stripes, concentric circles or columns of adhesive. Amongst the preferred constructions of the invention would be the presence of two stripes of adhesive on each side of the sheet, the stripes preferably being parallel. It is also advantageous to have the stripes located differently on each side of the sheet so that when the sheets are stacked, the lines of adhesive do not completely overlap or do not overlap at all. This can be done in a number of fashions. For example, the stripes may be longitudinal on one side and vertical on the other side of the sheet. A more desirable orientation would be to have the stripes on one side more centrally positioned (e.g., at a distance ⅜ and ⅝ the total distance along one dimension such as the width) and the stripes on the other side more edgewise distributed (e.g., at , ⅛ and ⅞ the total distance along one dimension such as the width). In this way, the sheets, when laid on top of each other would not have any adhesive overlap. The stripes run the length of both sides of each sheet, but do not touch when the sheets are placed one over the other. This prevents the adhesive on the various surfaces from co-mingling, co-dissolving, or otherwise interacting in a manner which could significantly alter the amount of adhesive on a sheet. The number of adhesive sheets in the pad will depend upon the number of photographs or art work expected to be inserted into the album. Usually at least 12 sheets would be desirable, more preferably at least 16 sheets, much more preferably at least 24 sheets (as there are 24 photographic prints available in the smallest rolls of print film usually marketed).

Cover sheets or liners are not essential between the individual sheets coated on both sides with repositionable adhesive, but may be used. A liner may be particularly desirable over the uppermost sheet in the pad, particularly if the pad is positioned within the cover sheets of the album. This would prevent the uppermost sheet from adhering to the album cover. It is also not necessary to provide a tab at one end or over one corner of the individual sheets to facilitate separation of the individual sheets, but this feature may be optionally provided. It is also possible to stagger or offset the edges of the individual sheets to facilitate separation of the individual sheets.

Although the size of the individual sheets is not critical, it is desirable that they be of smaller dimensions than the overall dimensions of the art work which is to be inserted in the album. As photographs, for example, come in various sizes, the sheets in the pad of repositionable adhesive sheets may be of various sizes. If wallet size photographs are to be used, the individual sheets could be of about 2×2 cm. If conventional size prints are to predominate as the art work in the album, sheets having dimensions of less than 3×5 inches (e.g., less than 7.5×12.5 cm) should be used. Dimensions between 1.5–7.5 cm by 1.5–12.5 cm would be a preferred range of dimensions, but sheets having size ranges between 1–15 cm by 1–20 cm could be particularly useful in other embodiments for example. If the individual sheets are larger than the art work inserted, the adhesive on the sheets would be exposed.

The pad of sheets may be adhered to the inside of the album, adjacent the exterior cover of the album (either on the cover or on the first page within the album). The pad may also be aesthetically presented by having a window cut into a cover sheet, with the pad attached either to a top or bottom page of the album so that the pad protrudes through the window, or have the pad attached by way of an adhesive which contacts the framing area of the window without extending into the window opening (which would present exposed adhesive to the unopened album).

As previously mentioned, tabs are not needed in the practice of the present invention, but may be used. For example, tabs can be placed over one edge of one or both sides of the individual sheets in the pad. This can facilitate the removal of the individual sheets. More complex constructions have been envisioned for the practice of the present invention, but for reasons of complexity and cost, they are less preferred. For example, a festoon can be manufactured in which there are three separate tapes which are temporarily secured together to form a tape with festoons therein. Two pairs of surfaces, each with a coating of repositionable adhesive can be secured into festoons. The two pairs of surfaces can be separated, exposing four surface areas of repositionable adhesive. A first two of the repositionable adhesive surfaces can be secured together, leaving the other two areas (and possibly an incompletely overlapped area of the first two areas) exposed on opposite sides of the resecured tape. The opened and reattached adhesive element would then present repositionable adhesive on both surfaces and could be used as a two-side coated repositionable tape for use in an album according to the practice of the present invention. The festoon-containing tape would be provided within or on the album in any convenient manner.

Tabs may be either removable or non-removable from the edges of the individual sheets. When the tabs are not readily removable from the sheets, reuses of the individual sheets and repositioning of the photographs can be facilitated. Another benefit of tabs in general is that individual sheets can be more readily removed from the stack of individual sheets by merely pressing the art work or photograph against the tape and then pulling an individual sheet with the photograph. The presence of the tab enables the individual sheets to be removed with less likelihood of multiple individual sheets being removed.

EXAMPLES

Example I

Cellulose acetate film was coated on both sides with commercially available repositionable microspherical adhesive based on N-methyl-pyrrolidone according to the method described in U.S. Pat. Nos. 4,883,553 and 4,842,919. The adhesive was applied in identical stripes on both sides of the film. The film was cut into individual sheets having stripes on both sides of the sheets, and the sheets were then assembled into a pad of sheets. The pad was adhered to the inside cover of an album having a number of pages by one of the exposed surfaces of a sheet having adhesive stripes thereon.

Tabs can be easily formed on an edge of each sheet to facilitate individual sheet removal. For example, silicone coated two-side coated paper strips can be adhered to one or both sides of an edge of adhesive sheet in a pad.

To adhere a photograph into an album, individual two-side bearing repositionable adhesive sheets are removed from the pad (tabs may be left on or removed), the individual sheet is applied to a page of an album or more preferably onto the backside of a photograph, and the photograph repositionably adhered to a page in the album by the individual sheet.

Example II

Individual two-side coated sheets were formed by using 3M Brand tape having conventional pressure-sensitive adhesive on two sides as a carrier for repositionable tape. The tape had single side coated repositionable adhesive sheets adhered to both surfaces of the tape. The adhesive sides of the repositionable adhesive sheets faced away from the tape so that a two sided repositionable composite sheet (of a tape core and two repositionable sheets) was formed. These composite sheets were then assembled into a pad for insertion into an album.

What is claimed:

1. An album comprising more than two pages free of pressure-sensitive adhesive, said album having a stack of sheets attached to said album, at least two of said sheets being removable from said stack and having repositionable pressure sensitive adhesive on both sides of said sheets which are removable, wherein said repositionable adhesive is the same adhesive on both sides of said sheets which are removable, there are no release liners between said removable sheets.

2. The album of claim 1 wherein the repositionable adhesive covers the entire surface of both sides of said sheets which are removable.

3. The album of claim 1 wherein the repositionable adhesive covers less than an entire surface on at least one side of said sheets which are removable.

4. The album of claim 1 wherein said repositionable adhesive covers less than an entire surface on both sides of said sheets which are removable.

5. The album of claim 4 wherein said repositionable adhesive is present as stripes on the surface of both sides of said sheets which are removable.

6. The album of claim 5 wherein said stripes are continuous stripes which extend from one edge of said sheets which are removable to another edge of said sheets which are removable.

7. The album of claim 5 wherein said stripes are positioned differently on each side of said sheets which are removable.

8. The album of claim 7 in which said stripes are positioned on each side of said sheets which are removable, wherein the stripes on a first side of said sheets have an average distance between them which is different from the average distance between stripes on a second side of the same said sheets.

9. The album of claim 8 in which the stripes on both sides of said sheets which are removable are parallel stripes.

10. The album of claim 9 in which said sheets which are removable are in contact with adjacent sheets so that the stripes on one sheet do not completely overlap the stripes on an adjacent second sheet.

11. The album of claim 9 in which said sheets which are removable are in contact with adjacent sheets so that the stripes on one sheet do not make any contact with stripes on an adjacent sheet.

12. An album comprising more than two pages free of pressure-sensitive adhesive, said album having a stack of sheets attached to said album, at least two of said sheets being removable from said stack and having repositionable pressure sensitive adhesive on both sides of said sheets which are removable, said album having a cover, said cover having a window, and said stack of sheets can be seen through said window.

13. The album of claim 1 in which the adjacent removable sheets do not have their edges aligned, so that individual sheets can be grasped by edges thereon.

14. The album of claim 1 in which individual removable sheets have tabs on at least one edge.

15. The album of claim 14 in which said tabs are removable from said individual sheets.

16. The album of claim 14 in which said tabs are not removable from said individual sheets.

17. The album of claim 12 wherein said repositionable adhesive is present as stripes on the surfaces of both sides of said sheets which are removable.

18. The album of claim 17 in which said stripes are positioned differently on each side of said sheets which are removable.

19. The album of claim 18 in which said stripes are positioned on each side of said sheets which are removable, wherein the stripes on a first side of said sheets have an average distance between them which is different from the average distance between stripes on a second side of the same said sheets.

20. The album of claim 19 in which said stripes are parallel stripes.

21. The album of claim 20 in which said removable sheets are in contact with adjacent removable sheets so that stripes on one removable sheet do not completely overlap stripes on an adjacent removable sheet.

22. The album of claim 21 in which the stripes on one sheet do not make any contact with stripes of adhesive on an adjacent removable sheet.

23. The album of claim 12 wherein there are no liners between adjacent removable sheets.

24. An album comprising more than two pages free of pressure-sensitive adhesive, said album having a stack of sheets attached to said album, at least two of said sheets being removable from said stack and having repositionable pressure sensitive adhesive on both sides of said sheets which are removable, said adhesive on both sides of said sheets being repositionable microspherical adhesive based on N-methyl-pyrrolidone.

25. The album of claim 24 wherein said microspherical adhesive on both sides of said sheet is the same adhesive on both sides of said sheet.

* * * * *